United States Patent [19]

Mercado-Torres

[11] Patent Number: 4,966,366

[45] Date of Patent: Oct. 30, 1990

[54] MATCHING WORD GAME EMPLOYING CUBES

[75] Inventor: Roberto Mercado-Torres, Cayey, P.R.

[73] Assignee: Commonwealth of Puerto Rico, San Juan, P.R.

[21] Appl. No.: 206,278

[22] Filed: Jun. 14, 1988

[51] Int. Cl.[5] ..... A63F 9/00

[52] U.S. Cl. ..... 273/1 R; 273/146; 434/172

[58] Field of Search ..... 273/1 R, 146, 153 R, 273/272; 434/172, 403

[56] References Cited

U.S. PATENT DOCUMENTS

| | | | |
|---|---|---|---|
| 557,307 | 4/1896 | Foster | 434/172 |
| 1,512,147 | 10/1924 | Tegtmeyer et al. | 273/272 |
| 1,524,529 | 1/1925 | Allen | 273/146 |
| 1,542,031 | 6/1925 | Bruhn | 273/146 X |
| 2,444,768 | 7/1948 | Eby | 434/403 X |
| 2,474,447 | 6/1949 | Wheelock | 434/172 |
| 3,314,168 | 4/1967 | Heckman | 273/146 X |
| 3,503,612 | 3/1970 | Singer | 273/272 |
| 4,402,513 | 9/1983 | Head | 273/299 X |

FOREIGN PATENT DOCUMENTS

| | | | |
|---|---|---|---|
| 934154 | 1/1948 | France | 273/146 |

*Primary Examiner*—Anton O. Oechsle

*Attorney, Agent, or Firm*—Scrivener and Clarke

[57] ABSTRACT

Preselected words, appearing on cards, are matched by aranging cubes with different letters on each face, some of which are repeated on different cubes in proportion to their frequency of use in the written language, so that the word is spelled out on the exposed upper faces of the cubes. Because some cubes contain two or more letters of a selected word, a player must select the proper cubes in a proper order lest an essential letter on a cube be unusable because another letter on that same cube has been used. The player who completes the word in the least time wins the round.

2 Claims, 1 Drawing Sheet

FIG. 1
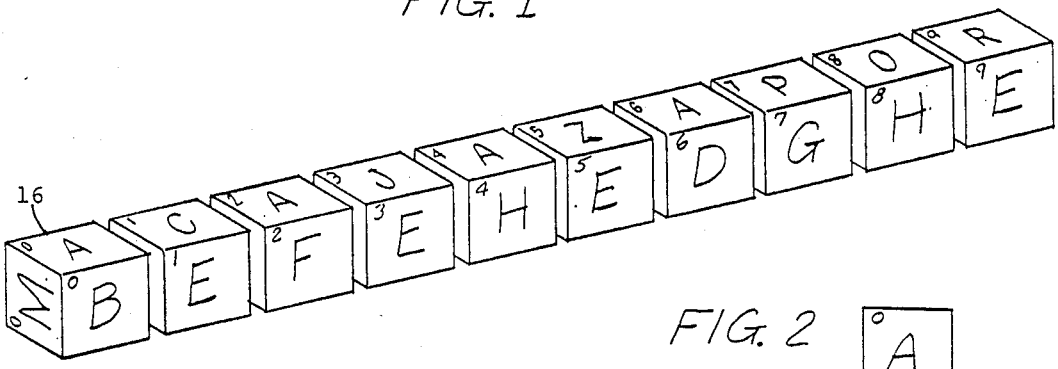
FIG. 2
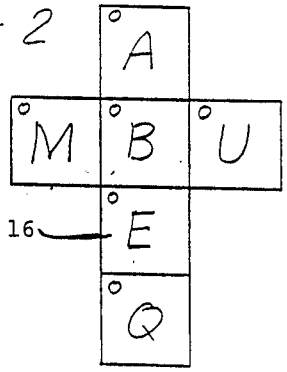
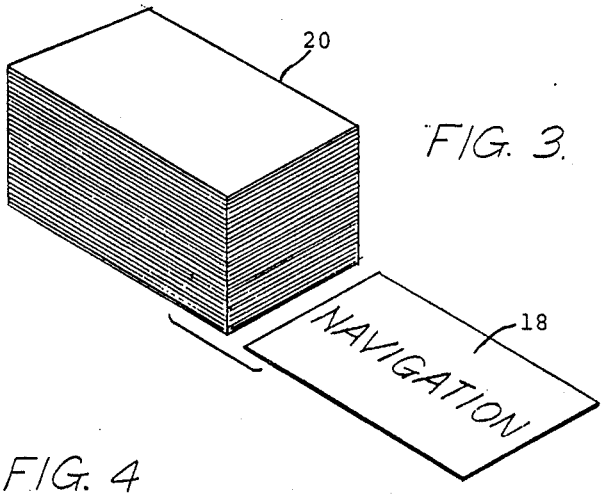
FIG. 3.
FIG. 4
| | | | | | | | | | |
|---|---|---|---|---|---|---|---|---|---|
| N | A | V | I | G | A | T | I | O | N |
FIG. 5
CUBE NUMBER 14
| CUBE SURFACE NUMBER | 0 | 1 | 2 | 3 | 4 | 5 | 6 | 7 | 8 | 9 |
|---|---|---|---|---|---|---|---|---|---|---|
| 1 | A | C | A | J | A | Z | A | P | O | R |
| 2 | B | E | F | E | H | E | D | G | H | E |
| 3 | E | M | U | B | I | K | Y | U | I | S |
| 4 | Q | I | K | Y | L | U | L | S | D | T |
| 5 | M | P | I | F | E | G | N | T | N | V |
| 6 | U | Y | Y | O | C | R | O | O | W | X |
← 10
12

MATCHING WORD GAME EMPLOYING CUBES

This invention relates to matching word games and more particularly to a game in which words corresponding to a selected word are formed by arrangement of letters appearing on the faces of cubes.

Word games where one arranges indicia on the faces of blocks in proper order conforming to a preselected order, e.g. words or numbers, are old. The present invention is similar to spelling blocks in that a plurality of cubes are provided, each cube having a different letter on its six faces. The cubes are arranged in sets, the number of cubes in a set being equal to the number of letters in the longest words which are to be spelled by the cubes. The number of cubes in a set must provide a total number of faces, in multiples of six, substantially greater than the number of letters in an alphabet in order that letters can be distributed at random among the faces of the cubes of the set in accordance with their frequency of use in the language, no letter being repeated on a single cube. Thus one cube may bear two letters of a selected word, one or more of these letters being also repeated on other cubes of the set. A player, in order to correctly match a word, must arrange the cubes correctly so that each letter is selected from a cube which does not also carry another letter of the word, which cannot be provided by any other cube. Each player has a set of cubes and each player endeavors to arrange his cubes to spell the preselected word in the shortest possible time. The words to be spelled or matched desirably appear on randomly arranged cards which are drawn in sequence to commence play. The words must be predetermined so that each can, in fact, be matched by the letters on the cubes, so long as they are correctly arranged.

By requiring the players to match the letters in a preselected word, each player not only learns a word, possibly new to him, but through the manipulation of the blocks he learns to spell the word, as well as developing his psychomotor abilities by turning over the cubes as fast as possible in search of the letters that form the words required by the game.

The game will be better understood when the following detailed description is read in conjunction with the accompanying drawings wherein:

FIG. 1 is a perspective view of a set of cubes bearing letters on their respective faces in accordance with the invention;

FIG. 2 is a view of all six faces of one of the respective cubes of FIG. 1;

FIG. 3 is a perspective view of a stack of cards each of which bears a printed word which can be formed by faces of the cubes of FIG. 1;

FIG. 4 is a top plan view of the blocks of FIG. 1 properly arranged to spell a preselected word appearing on one of the printed cards; and FIG. 5 is a table with letters arranged corresponding to the number of sides of each of the respective cubes.

Referring first to FIG. 5, let it be assumed that the game will consist of ten cubes which is equal to the number of letters appearing in the longest preselected word. With ten cubes there are sixty faces to be apportioned among twenty-six letters of the alphabet in accordance with the frequency of use of the respective letters in the language. Thus as a first step one forms a table 10 divided into six numbered rows 12, one row for each face of each cube and ten numbered columns equal in number to the number of cubes chosen for the game. The letters, in accordance with their frequency of use are then distributed among the columns, care being taken that no letter appears more than once in any column. Since E is the most frequently used letter in the English language it may be randomly distributed among six of the ten columns. The remaining five vowels, A, I, 0, U, Y may then be randomly distributed among the ten columns except that each vowel is repeated only four times. In like manner the other most frequently used letters, B, C, D, F, G, H, K, L, M, N, P, R, S, T, are randomly distributed along the columns with each of these letters being repeated only twice. Finally, the least used letters, J, Q, V, W, X, Z are distributed in the remaining spaces in the table with each of the letters appearing only once.

When the table has been made up as above described the letters, as they appear in each column, are transferred to a face of a cube, such as cube 16 in FIG. 1, it being apparent that each face of the first cube 16 will bear the letters as they appear in the column number 0 in FIG. 5. The letters A, B, E, Q, M, U, thus appear on the respective faces of cube 16 as shown in FIG. 2. Desirably each face of each cube also bears a number corresponding to its column in the table. Thus cube 16 bears on each face the numeral 0, the faces of the next cube bears the numeral 1 and so on for each cube in the set. Thus it should be understood that each cube, numbered 0 to 9, bears on its respective faces the letters appearing in the respective columns numbered 0 to 9 in the table 10. The letters can be placed on the respective faces randomly and need not be in any order though only those letters appearing in any column should appear on the faces of the cube corresponding to that column.

Identical sets of cubes are prepared equal to the maximum number of players expected to play.

The next task is to derive suitable preselected words having a number of letters not in excess of the number of cubes. The words must be derived from the table and should be tabulated for future transfer to individual cards such as the card 18 shown in FIG. 3, which is one of a stack 20 of similar cards each of which bears a word derived from the table of FIG. 5. The words can have any number of letters therein up to ten, this being the total number of cubes in a set. In making up the list of words, it will be apparent that a letter for each word must be selected from a separate column. Short words, such as FOOT will be easier to duplicate on the cubes than will a longer word such as MAGNETIC, it being noted from the table that two cubes, those numbered 0 and 1, both bear the letters E and M. Cube 7 bears both a G and a T. Thus, a player is challenged to arrange the cubes in the correct order, it being understood that if he selects a letter on one cube which also bears another letter not available on another cube he will have to start all over again.

A word having ten letters therein, if that is the number of cubes in each set, is the most difficult of all to repeat on the upper faces of the cubes. The example shown in FIG. 4 is the word NAVIGATION which has two A's and two I's. Since the letter V appears on the cube numbered 9, a player should not select the T appearing also on cube 9 but rather he must select the T on cube 7. However, he should not have chosen cube 7 for its 0 but should choose cube 6 bearing in mind, though, that cube 6 also bears the letter N. A final though not the only solution for the word NAVIGA- TION is the order of cubes as their numbers appear in FIG. 4, it being possible to repeat at least some ten letter words and others with less than ten letters with more than one combination of cubes. Thus, the master list of words derived from the table 10 should bear adjacent each letter a cube number of at least one combination which can make up that word and the list may provide all combinations of at least long words. Short words, such as FOOT, will be obvious, but it's possible that no player will be able to duplicate a ten letter word and such a word is likely to be challenged as being impossible of solution. By having available the master list with the cube numbers appearing adjacent each letter in a word, any challenge can be met. It is contemplated that a master list will contain about forty words from four to ten letters, each word appearing on a separate card.

Though it is possible that some players, may, after repeated use, memorize the proper order of cube numbers for words appearing on the respective cards, the cubes still must be turned over rapidly in order to align the correct letters to spell the words. A timer, such as minute glass, may be employed though score is kept by tabulating which of the players is the first to duplicate any given word.

From the foregoing description it can be seen that the present invention goes beyond the mere spelling of words by blocks each face of which bears a letter of the alphabet, those faces in excess of twenty-six bearing some other indicia.

Though the invention has been described as it would be used for matching preselected English words, it will be apparent that the master table can be adapted to other languages, for example, Spanish, where one of the columns, instead of being composed of individual letters, can be composed of combined letters which are treated as a single letter in Spanish. The single letters could be distributed among the other blanks of the table in proportion to their frequency of use in Spanish.

It should be apparent that the order of letters appearing in the table in FIG. 5 can vary over a wide range and is not intended to be restricted to the precise order shown. Further the rules of the play can vary significantly. For example, each player could have a stack of cards. All of the players may initially lay down one card from their respective stacks and all endeavor to match the longest word appearing on the cards. The first to match the word calls "time" and then lays down one of his cards for all to match. The first player correctly using all of his cards wins.

Thus the invention is susceptible of a variety of changes without, however, departing from the scope and spirit of the appended claims.

I claim:

1. A matching word game comprising a set of identical six sided cubes, the number of cubes in said set being at least equal to the number of letters in a preselected word, each face of each cube bearing a different letter, some of the sides of different cubes bearing the same letter in accordance with the approximate frequency of usage of the letters in words, a plurality of cards, each bearing a preselected word composed of letters each of which appears on a face of a separate cube with said word having no more letters than the number of cubes for duplication on the exposed upper faces of the cubes when the latter are arranged by turning or locating or both in an order corresponding to the preselected word, each face of each cube also bearing a number which is the same on each face of each cube but different from every other cube in the set, and a table from which the words appearing on the respective cards are selected, said table comprising six rows of spaces arranged in columns equal to the number of cubes, the six spaces in each column bearing the letters appearing on the six sides of each cube, each letter for a selected word appearing in a different column, said columns being numbered to correspond to the number on each cube whereby each letter of each preselected word on a card has a number equivalent, no two letters appearing in any preselected work on a card having the same number equivalent.

2. The word game of claim 1, including a master list of all the words on said cards, each letter of each word on said list bearing adjacent thereto the cube number of at least one combination of cubes making up that word.

* * * * *